US009133418B1

(12) United States Patent
Miralles

(10) Patent No.: US 9,133,418 B1
(45) Date of Patent: Sep. 15, 2015

(54) NON-SILICATED HIGH ALKALINE CLEANER WITH ALUMINUM PROTECTION

(71) Applicant: Ecolab USA Inc., St. Paul, MN (US)

(72) Inventor: Altony J. Miralles, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/246,206

(22) Filed: Apr. 7, 2014

(51) Int. Cl.
*C11D 1/66* (2006.01)
*C11D 3/10* (2006.01)
*C11D 3/00* (2006.01)

(52) U.S. Cl.
CPC ..... *C11D 3/0073* (2013.01)

(58) Field of Classification Search
None
See application file for complete search history.

(56) References Cited

U.S. PATENT DOCUMENTS

| | | | |
|---|---|---|---|
| 2,478,390 | A | 8/1949 | Hanford |
| 2,957,931 | A | 10/1960 | Hamiton et al. |
| 3,923,876 | A | 12/1975 | Heins et al. |
| 3,959,168 | A | 5/1976 | Germscheid et al. |
| 4,042,324 | A | 8/1977 | Auel et al. |
| 4,057,511 | A | 11/1977 | Bohnsack et al. |
| 4,351,796 | A | 9/1982 | Marshall |
| 5,078,894 | A | 1/1992 | Horwitz et al. |
| 5,082,592 | A | 1/1992 | McDonald |
| 5,230,824 | A | 7/1993 | Carlson, Sr. et al. |
| 5,264,041 | A | 11/1993 | Kuhnke et al. |
| 5,273,675 | A | 12/1993 | Lein et al. |
| 5,587,142 | A | 12/1996 | Horwitz et al. |
| 5,606,105 | A | 2/1997 | Davis et al. |
| 5,614,028 | A | 3/1997 | Rodzewich |
| 5,650,385 | A | 7/1997 | Dunn et al. |
| 5,736,495 | A | 4/1998 | Bolkan et al. |
| 5,747,439 | A | 5/1998 | Dunn et al. |
| 5,834,411 | A | 11/1998 | Bolkan et al. |
| 6,210,600 | B1 | 4/2001 | Zhou et al. |
| 6,348,440 | B1 | 2/2002 | Meskers, Jr. et al. |
| 6,403,028 | B1 * | 6/2002 | Colby et al. ..... 422/15 |
| 2005/0242042 | A1 | 11/2005 | Moriarty et al. |
| 2005/0245411 | A1 | 11/2005 | Yang et al. |
| 2006/0040843 | A1 | 2/2006 | Kinnaird et al. |
| 2006/0097229 | A1 | 5/2006 | Grech et al. |
| 2008/0021167 | A1 | 1/2008 | Rodrigues |
| 2008/0127995 | A1 | 6/2008 | Kinnaird et al. |
| 2010/0111756 | A1 | 5/2010 | Crovetto et al. |
| 2010/0116473 | A1 | 5/2010 | Yang et al. |
| 2010/0197545 | A1 * | 8/2010 | Silvernail et al. ..... 510/219 |

(Continued)

FOREIGN PATENT DOCUMENTS

| | | | |
|---|---|---|---|
| EP | 0 491 391 B2 | 4/2002 | |
| WO | WO 00/44677 * | 8/2000 | ..... C02F 5/10 |

(Continued)

*Primary Examiner* — Brian P Mruk

(74) *Attorney, Agent, or Firm* — McKee, Voorhees & Sease, PLC

(57) ABSTRACT

Warewashing detergents suitable for dishwashing, immersion or dipping cleaning, and hard surface cleaning are disclosed for use on hard surfaces, including for example alkaline sensitive metals, such as aluminum or aluminum containing alloys. Alkaline compositions of a mixture of phosphono ethane carboxylates phosphono oligomers and methods employing the same are disclosed. The compositions eliminate the use of highly abrasive silicates, while retaining cleaning performance and corrosion prevention. The compositions according to the invention prevent the corrosive effect of highly alkaline compositions on aluminum or aluminum containing alloys.

19 Claims, 7 Drawing Sheets

(56) References Cited

U.S. PATENT DOCUMENTS

| | | | |
|---|---|---|---|
| 2011/0000505 | A1 | 1/2011 | Yang et al. |
| 2012/0053104 | A1 | 3/2012 | Olson et al. |
| 2012/0216834 | A1 | 8/2012 | Yang et al. |
| 2013/0102518 | A1 | 4/2013 | Miralles et al. |
| 2013/0252872 | A1 | 9/2013 | Olson et al. |
| 2014/0066355 | A1 | 3/2014 | Miralles et al. |

FOREIGN PATENT DOCUMENTS

| | | | |
|---|---|---|---|
| WO | WO 02/48049 | A1 | 6/2002 |
| WO | 2007004175 | | 1/2007 |

* cited by examiner

NON-SILICATED HIGH ALKALINE CLEANER WITH ALUMINUM PROTECTION

FIELD OF THE INVENTION

The invention relates to corrosion inhibiting warewash and other hard surface cleaning compositions and detergents incorporating the same provide stain removal from alkaline sensitive metals, such as aluminum or aluminum containing alloys. Alkaline compositions of phosphono oligomers, such as phosphono ethane carboxylates are provided and methods employing the same. The compositions eliminate the use of highly abrasive silicates, while retaining cleaning performance and corrosion prevention. According to the invention, a mixture of phosphono ethane carboxylates prevents the corrosive effect of highly alkaline compositions on aluminum or aluminum containing alloys.

BACKGROUND OF THE INVENTION

Conventional detergents used in warewashing include alkaline detergents. Alkaline detergents, particularly those intended for institutional use, can affect the appearance of metals, particularly soft metals such as aluminum. For example, alkaline detergents can create blackening or corrosion on aluminum pans. Conventionally, alkaline detergents have contained phosphates to reduce corrosion. However, increased regulation of the use of phosphorus in detergents, as well as an ever increasing trend towards safer and sustainable detergent compositions, has created a need to identify alternative anti-corrosion compositions. This has led to the development of alternative complexing agents, builders, threshold agents, corrosion inhibitors, and the like, which are used instead of predominantly phosphorus containing compounds. Phosphates can bind calcium and magnesium ions, provide alkalinity, act as threshold agents, and protect alkaline sensitive metals such as aluminum and aluminum containing alloys.

Other corrosion inhibitors include silicates, such as, sodium silicate. Sodium silicate has a tendency to begin precipitating from aqueous solution at a pH below 11, thus reducing its effectiveness to prevent corrosion of the contacted surfaces when used in cleaning solutions having a lower pH. Additionally, when allowed to dry on a surface silicates form films and/or spots which are visible and they are very difficult to remove. The presence of these silicon containing deposits can affect the texture, appearance and on cooking or storage surfaces the taste of the materials that come into contact with the cleaned surfaces.

It is an object of the invention to address at least one of the above problems and/or to offer detergent compositions with usage and/or environmental benefits.

Accordingly it is an object herein to provide an improved warewashing and other hard surface cleaning composition for the removal of stains without causing abrasion or other damage to aluminum or aluminum alloy metals.

It is another object of the invention to provide a method and process for employing the warewashing and other hard surface cleaning compositions.

Other objects, aspects and advantages of this invention will be apparent to one skilled in the art in view of the following disclosure, the drawings, and the appended claims.

SUMMARY OF THE INVENTION

Applicants have surprisingly discovered an alkaline detergent composition for protection of aluminum metals (or aluminum alloy containing metals) treated with highly alkaline and high temperature cleaning compositions without the use of silicates. Beneficially, the eliminated use of highly abrasive silicates provides detergent compositions suitable for warewashing, dipping or immersion and/or other hard surface cleaning.

In one embodiment, the present invention is an alkaline cleaning composition including at least one phosphonated oligomer, at least one alkalinity source, and at least one AMPS copolymer. The alkaline cleaning composition may further include a complexing agent, a nonionic surfactant, water and/or sodium gluconate or another protectant to provide improved shine to the treated surface. In an embodiment the treated hard surface may include an alkaline-sensitive metal surface. Beneficially, the alkaline cleaning composition is free of silicates.

In yet another embodiment, the invention also includes methods for cleaning aluminum and/or aluminum containing alloys by contacting the surface of the same with the detergent/cleaning compositions of the invention. The methods according to the invention are suitable for removing soils. In some aspects, the detergent compositions according to the invention are mixed with water to form a use composition.

In another embodiment, the invention also includes methods for protecting aluminum and/or aluminum containing alloys from corrosion by use of the novel corrosion inhibiting composition of the invention. The method involves the step of contacting the surface of aluminum, or an aluminum containing alloy with the corrosion inhibiting composition of the invention.

Articles which require such cleaning according to the invention includes any article with a surface that contains an alkaline sensitive metal, such as, aluminum or aluminum containing alloys. Such articles can be found in industrial plants, maintenance and repair services, manufacturing facilities, kitchens, and restaurants. Exemplary equipment having a surface containing an alkaline sensitive metals include sinks, cookware, utensils, machine parts, vehicles, tanker trucks, vehicle wheels, work surfaces, tanks, immersion vessels, spray washers, and ultrasonic baths. In addition, a detergent composition is provided according to the invention that can be used in environments other than inside a dishwashing machine. Alkaline sensitive metals in need of cleaning are found in several locations. Exemplary locations also include trucks, vehicle wheels, ware, and facilities. One exemplary application of the alkaline sensitive metal cleaning detergent composition for cleaning alkaline sensitive metals can be found in cleaning vehicle wheels in a vehicle washing facility. Compositions including the novel corrosion inhibitor of the invention may be used in any of these applications and the like.

These and other objects, advantages and features of the present invention will become apparent from the following specification taken in conjunction with the claims set forth herein.

Figure 1:
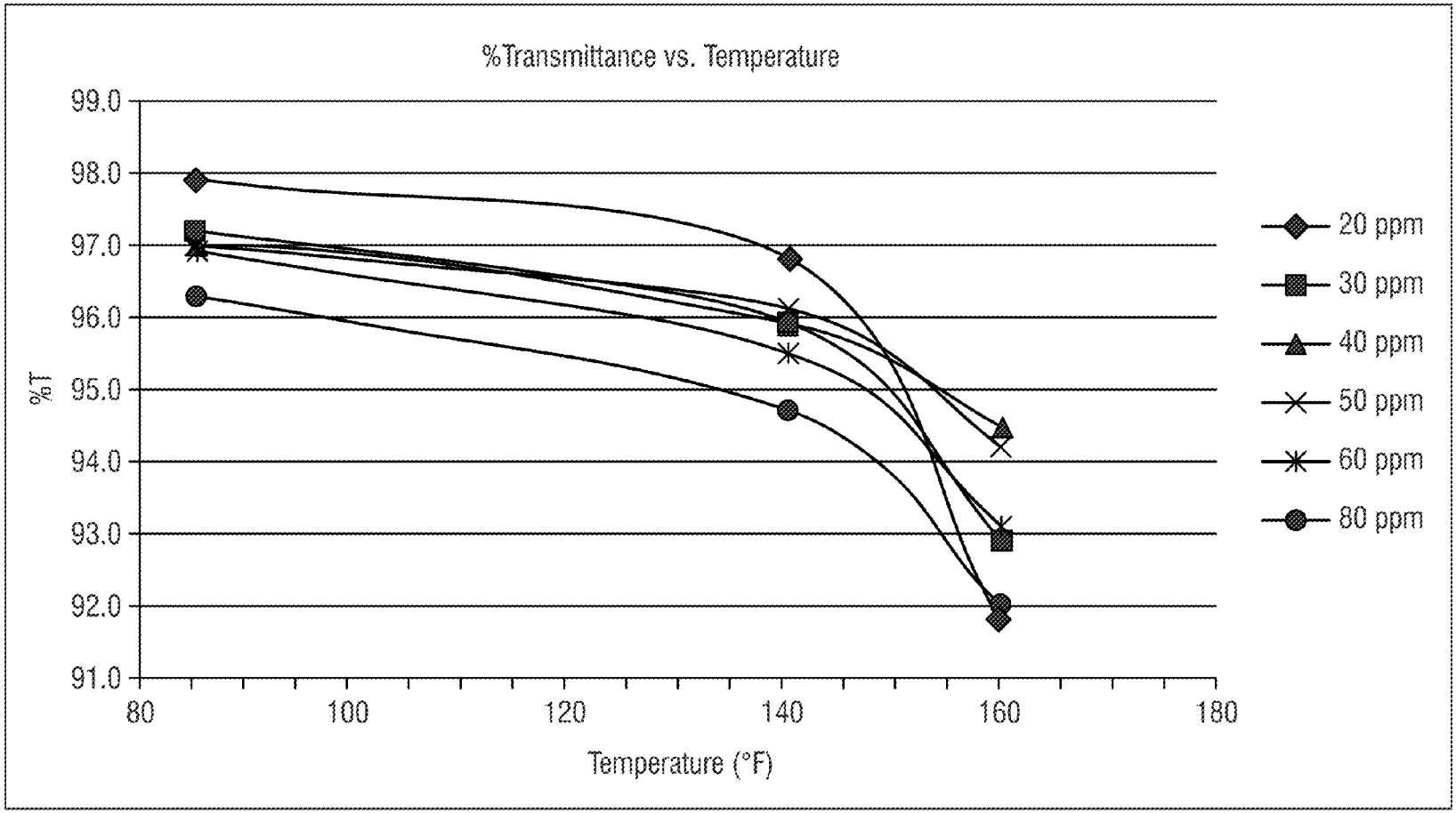
FIG. 1 shows the percentage transmittance of solutions at increasing temperatures according to embodiments of the invention employing phosphonated oligomers (Bricorr 288) to measure precipitate levels.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

The embodiments of this invention are not limited to particular methods and/or compositions for cleaning alkaline sensitive metals without having to use silicates, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range. So that the invention maybe more readily understood, certain terms are first defined and certain test methods are described.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

As used herein, the phrase "alkaline sensitive metal" identifies those metals that exhibit corrosion and/or discoloration when exposed to an alkaline detergent in solution. An alkaline solution is an aqueous solution having a pH that is greater than 7, or preferably greater than 8. Exemplary alkaline sensitive metals include soft metals such as aluminum, nickel, tin, zinc, copper, brass, bronze, and mixtures thereof. Aluminum and aluminum alloys are common alkaline sensitive metals that can be cleaned by the alkaline cleaning compositions of the invention.

As used herein, the term "cleaning" refers to a method used to perform, facilitate or aid in soil removal, bleaching, descaling, de-staining, microbial population reduction, and any combination thereof.

As used herein, the term "phosphorus-free" refers to a composition, mixture, or ingredient that does not contain more than 0.5 wt-% phosphorus or a phosphorus-containing compound. In an aspect, the compositions according to the invention contain less than 0.5 wt-% phosphorus or a phosphorus-containing compound, or more preferably less than about 0.1 wt-% phosphorus or a phosphorus-containing compound. In an aspect, the compositions according to the invention are phosphorus-free.

As used herein, a "solid" cleaning composition refers to a cleaning composition in the form of a solid such as a powder, a particle, agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the detergent composition will remain in solid form when exposed to elevated temperatures of 100° F. and preferably 120° F. A cast, pressed, or extruded "solid" may take any form including a block. When referring to a cast, pressed, or extruded solid it is meant that the hardened composition will not flow perceptibly and will substantially retain its shape under moderate stress, pressure, or mere gravity. For example, the shape of a mold when removed from the mold, the shape of an article as formed upon extrusion from an extruder, and the like. The degree of hardness of the solid cast composition can range from that of a fused solid block, which is relatively dense and hard similar to concrete, to a consistency characterized as being malleable and sponge-like, similar to caulking material.

As used herein, the term "substantially free" refers to compositions completely lacking the component or having such a small amount of the component that the component does not affect the performance of the composition. The component may be present as an impurity or as a contaminant and shall be less than 0.5 wt. %. In another embodiment, the amount of the component is less then 0.1 wt. % and in yet another embodiment, the amount of component is less than 0.01 wt. %.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both. According to an aspect of the invention, the alkaline cleaning compositions provide at least substantially similar cleaning performance and corrosion inhibition or protection in comparison to conventional corrosion inhibiting detergents comprising silicates.

The term "surfactant" or "surface active agent" refers to an organic chemical that when added to a liquid changes the properties of that liquid at a surface.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

The recitation of numerical ranges by endpoints includes all numbers subsumed within that range (e.g. 1 to 5 includes 1, 1.5, 2, 2.75, 3, 3.80, 4, and 5).

Alkaline Cleaning Compositions

According to an embodiment of the invention, alkaline corrosion inhibiting cleaning compositions comprise, consist essentially of and/or consist of at least one phosphonated oligomer corrosion inhibitor component and an alkalinity source. In other embodiments, the alkaline corrosion inhibiting cleaning compositions comprise, consist essentially of and/or consist of at least one phosphonated oligomer corrosion inhibitor component, an alkalinity source, and at least one crystal modifying polymer. In still further embodiments, the cleaning compositions comprise, consist essentially of and/or consist of at least one phosphonated oligomer corrosion inhibitor component, an alkalinity source, at least one crystal modifying polymer, and a mild chelant and/or surfactant. In still further embodiments, the cleaning compositions comprise, consist essentially of and/or consist of at least one phosphonated oligomer corrosion inhibitor component, an alkalinity source, at least one crystal modifying polymer, a mild chelant, a surfactant, and/or additional functional ingredients.

Without wishing to be bound by any particular theory, it has been found that the phosphonated oligomer corrosion inhibitor components, namely the phosphono ethane carboxylates, effectively replace silicates as protective polymers against corrosion caused on metal surfaces by highly caustic cleaning compositions. Unexpectedly, the cleaning compositions according to the invention replace compositions containing silicates for corrosion inhibition. Therefore, in an aspect of the invention, the cleaning compositions are silicate-free.

Exemplary ranges of the alkaline, corrosion inhibiting cleaning compositions according to embodiments of the invention are shown in Table 1 in weight percentage of the cleaning compositions in a concentrated block.

TABLE 1

| Material | First Exemplary Range wt-% | Second Exemplary Range wt-% | Third Exemplary Range wt-% | Fourth Exemplary Range wt-% |
|---|---|---|---|---|
| Phosphonated oligomer | 0.1-75 | 1-50 | 5-25 | 10-15 |
| AMPS polymer | 0.01-75 | 0.1-50 | 1-25 | 5-20 |
| Alkalinity source | 1-90 | 5-80 | 10-75 | 40-75 |
| Complexing Agent (i.e. mild chelant) | 0-75 | 0.1-50 | 5-50 | 10-30 |
| Surfactant | 0-25 | 0.001-10 | 0.01-5 | 0.1-0.5 |
| Additional functional ingredient(s) | 0-50 | 0.01-40 | 0.1-40 | 1-25 |
| Silicates | 0 | 0 | 0 | 0 |

The alkaline cleaning compositions according to the invention are preferably used at use concentrations of at least 900 ppm, preferably at least 1000 ppm, and still more preferably at 2000 ppm or greater.

The alkaline cleaning compositions according to the invention have a use solution pH of at least about 8. In other aspects the compositions according to the invention have a use solution pH of at least about 10, or at least about 12.

The alkaline cleaning compositions can be made available as concentrates that are diluted (or as multiple concentrates that are diluted and combined) at the situs of use to provide a use solution for application a variety of surfaces, namely hard surfaces. In a particular aspect, the alkaline cleaning compositions are suitable for application to alkaline sensitive metals. An advantage of providing concentrates that are later combined is that shipping and storage costs can be reduced because it can be less expensive to ship and store a concentrate rather than a use solution and is also more sustainable because less packaging is used. Although the detergent composition according to the invention can be provided as multiple concentrates, it should be understood that the composition can be provided as a ready to use solution. Concentrates can be provided in the form of a liquid, solid, paste, gel, granulate, or powder.

Phosphonated Oligomers

According to an embodiment of the invention, alkaline, corrosion inhibiting cleaning compositions includes at least one phosphonated oligomer. Phosphonated oligomers are preferably combined to form a mixture of phosphonated oligomers.

In some embodiments, phosphonocarboxylic acids or salts are employed, such as phosphonated oligomer of maleic acid, having the general formula $H[CHCO_2M.CHCO_2M].PO_3M_2$ wherein M is a cation, and n is equal or greater than 1. Additional disclosure of the phosphonocarboxylic acids and salts is set forth in EP 0491391, which is incorporated herein by reference in its entirety. In an aspect, a mixture of phosphonocarboxylic acids or salts are employed.

In a preferred aspect, a commercially-available phosphonated oligomer is Bricorr 288 Bricorr, a 40 wt % sodium salt solution of a phosphono-carboxylic acid mixture (Rhodia). The commercially-available mixture is tetrasodium phosphonoethane-1,2-dicarboxylate and hexasodium phosphonobutane-1,2,3,4-tetracarboxylate (CAS No. 143239-08-1).

The corrosion inhibitor component can be provided in the corrosion inhibitor concentrate in an amount sufficient to provide a desired level of corrosion inhibition when used in the use solution. There should be sufficient amount of corrosion inhibitor to provide the desired corrosion inhibiting affect. It is expected that the upper limit on the corrosion inhibitor component will be controlled by solubility.

In some embodiments, the phosphonated oligomers are present in the alkaline cleaning compositions at an amount of about 0.1 wt-% to about 75 wt-%, about 1 wt-% to about 50 wt-%, about 5 wt-% to about 25 wt-%, or about 10 to about 15 wt-%. It is to be understood that all ranges and values between these ranges and values are encompassed by the present compositions.

Alkalinity Source

In some aspects the alkaline cleaning compositions include an alkalinity source. In an aspect, the alkalinity source is a caustic-based alkalinity source, including, for example, alkali metal hydroxides. Exemplary alkali metal hydroxides that can be used include, but are not limited to sodium, lithium, or potassium hydroxide. In preferred aspects, the alkalinity source is sodium hydroxide.

In other aspects, the alkalinity source is a carbonate-based alkalinity source, including, for example, carbonate salts such as alkali metal carbonates; metal borate, and organic alkalinity sources. Alkali metal carbonates include for example sodium carbonate. Additional alkali metal carbonates include, for example, sodium or potassium carbonate. In aspects of the invention, the alkali metal carbonates are further understood to include metasilicates, silicates, bicarbonates and sesquicarbonates. According to the invention, any "ash-based" or "alkali metal carbonate" shall also be understood to include all alkali metal carbonates, metasilicates, silicates, bicarbonates and/or sesquicarbonates.

In a still further aspect, the alkalinity source is a combination of both an alkali metal hydroxide and an alkali metal carbonate alkalinity source.

Organic alkalinity sources include for example strong nitrogen bases including ammonia, amines, alkanolamines, and amino alcohols. Exemplary amines include primary, secondary or tertiary amines and diamines carrying at least one nitrogen linked hydrocarbon group, which represents a saturated or unsaturated linear or branched alkyl group. In a preferred aspect, an alkylamine salt is provided as an alkalinity source for the cleaning composition. Examples of alkanolamines include monoethanolamine, monopropanolamine, diethanolamine, dipropanolamine, triethanolamine, tripropanolamine and the like. Examples of amino alcohols invention include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

In preferred aspects, the alkaline cleaning compositions do not include organic alkalinity sources, as alkali metal hydroxides and/or alkali metal carbonates are preferred alkalinity sources suitable for compositions for both industrial and/or commercial applications of use.

A number of commercially available alkalinity sources may be suitable for use in embodiments of the present invention. For example, suitable commercially available caustic soda include, but are not limited to, liquid caustic soda (sodium hydroxide) as 50% (alkali equivalent, wt % $Na_2O$ about 39%) and 73% (alkali equivalent, wt % $Na_2O$ about 57%) solutions in water available from PPG Industries. (Pittsburgh, Pa.). Suitable commercially available alkyl alkanolamines include, but are not limited to, monoethanolamine ($HOCH_2CH_2NH_2$) as MEA grade, MEA LFG grade (an 85% solution of monoethanolamine with 15% water), and MEA ICF grade available from Dow Chemical Company (Midland, Mich.).

The source of alkalinity is provided in an amount sufficient to provide the use solution with a pH of at least 8.0. The use solution pH range is preferably between about 8.0 and about 13.0, and more preferably between about 10 to 12.5.

In some embodiments, the alkalinity source is present in the compositions at an amount of about 0.01 wt-% to about 99 wt-%, about 0.05 wt-% to about 95 wt-%, about 1 wt-% to about 80 wt-%, about 5 wt-% to about 80 wt-%, about 10 wt-% to about 75 wt-%, or at least about 40 wt-% or preferably about 40 wt-% to about 75 wt-%. It is to be understood that all ranges and values between these ranges and values are encompassed by the present compositions.

AMPS Corrosion Inhibitor Polymer

In some aspects, the alkaline cleaning compositions include at least one AMPS polymer, which may also be referred to as a crystal modifying polymer. As referred to herein, a crystal modifying polymer may also be referred to as threshold inhibitors, which are known by skilled artisans to prevent calcium carbonate precipitation in alkaline use solutions. In general, it is expected that the threshold agent/crystal modifier component will loosely hold calcium to reduce precipitation of calcium carbonate once it is subjected to a pH of at least 8.0.

In some embodiments, at least one 2-Acrylamido-2-methylpropane sulfonic acid (AMPS) copolymer is employed. In one embodiment, the AMPS copolymer used in the detergent composition is a copolymer of AMPS and a carboxylic acid. Suitable carboxylic acids for use in the copolymer include acrylic acid, methacrylic acid and maleic acid. Copolymers of acrylic acid/AMPS may be particularly suitable for use in embodiments of the present invention. Commercially available examples of such copolymers include Aquatreat AR 545 available from Alco Chemical and Acumer 2000 available from Dow Chemical.

In one embodiment, the detergent composition in concentrated form includes at least about 1.0 wt-% of the AMPS copolymer, more particularly, between about 1.0 and 25.0 wt-% AMPS copolymer, even more particularly, between about 3.0 and 10.0 wt-% AMPS copolymer, and even more particularly, between about 4.0 wt-% and about 8.0 wt-% AMPS copolymer.

In some embodiments, the crystal modifying polymers are present in the alkaline cleaning compositions at an amount of about 0.01 wt-% to about 75 wt-%, about 0.1 wt-% to about 50 wt-%, about 1 wt-% to about 25 wt-%, or about 5 wt-% to about 15 wt-%. It is to be understood that all ranges and values between these ranges and values are encompassed by the present compositions.

Surfactants

In some aspects, the alkaline cleaning composition includes a surfactant component. A surfactant or surfactant mixture may be included in the alkaline cleaning compositions. The surfactant beneficially provides cleaning properties when used as part of the use solution of the alkaline cleaning compositions.

A variety of surfactants can be used in the alkaline cleaning composition, such as anionic, nonionic, and amphoteric. It should be understood that surfactants are an optional component of the alkaline cleaning composition and can be excluded. In a preferred aspect, a nonionic low-foaming surfactant is employed.

The particular surfactant or surfactant mixture chosen for use in the process and products of this invention can depend on the conditions of final utility, including method of manufacture, physical product form, use pH, use temperature, time required and other factors determined according to the particular methods of use of the alkaline cleaning compositions. Exemplary surfactants that can be used are commercially available from a number of sources. For a discussion of surfactants, see Kirk-Othmer, Encyclopedia of Chemical Technology, Third Edition, volume 8, pages 900-912.

Nonionic surfactants useful in alkaline cleaning compositions include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF), and the like; and other like nonionic compounds.

Anionic surfactants useful in alkaline cleaning compositions include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

A surfactant(s) can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents can be utilized to reduce the generation of foam. Accordingly, surfactants that are considered low foaming surfactants as well as other surfactants can be used in the detergent composition and the level of foaming can be controlled by the addition of a defoaming agent.

In some embodiments, surfactants are present in the alkaline cleaning compositions at an amount of about 0 wt-% to about 50 wt-%, about 0.001 wt-% to about 25 wt-%, about 0.001 wt-% to about 10 wt-%, about 0.01 wt-% to about 5 wt-%, or about 0.1 wt-% to about 0.5 t-%. It is to be understood that all ranges and values between these ranges and values are encompassed by the present compositions.

Complexing Agents

In some aspects, the alkaline cleaning compositions include a complexing agent. In some embodiments, the optional complexing agent may bind to metal in use to form a metal complex.

Suitable complexing agents may have a pKf (logarithm of the equilibrium constant of formation) from about 0.0 to about 12.0, more particularly, from about 1.0 to about 6.0. Examples of suitable complexing agents comprise acids and acid salts including citric acid and citric acid salts such as sodium citrate, tartaric acid and tartaric acid salts such as sodium tartrate, methylglycinediacetic acid and methylglycinediacetic acid salts such as trisodium methylglycinediacetic acid, maleic acid and its salts, ethylenediaminetetraacetic acid and its salts, glutamic N,N-diacetic acid and salts such as glutamic N,N-diacetic acid disodium salt, glucaric acid and its salts, saccharic and lactic acid and their salts. Tartaric acid, citric acid, gluconic acid and their salts may be particularly suitable for embodiments of the present invention with citric acid and its salts being particularly suitable.

In some embodiments, a complexing agent(s) is present in the alkaline cleaning compositions at an amount of about 0 wt-% to about 75 wt-%, about 0.1 wt-% to about 50 wt-%, about 5 wt-% to about 50 wt-%, or about 10 wt-% to about 30 wt-%. It is to be understood that all ranges and values between these ranges and values are encompassed by the present compositions.

Water

In many embodiments, the alkaline cleaning compositions include in the formulation and/or are diluted with a water source to generate a use solution. Those of skill in the art will be capable of selecting the grade of water desired with the desired level of water hardness and grain.

Water may be independently added to the alkaline composition or may be provided as a result of its presence in an aqueous material that is added to the alkaline composition. For example, materials added to the detergent composition may include water or may be prepared in an aqueous premix available for reaction with the detergent component(s). For solid blocks, water may be introduced to provide a desired rate of solidification. The water may also be present as a processing aid and may be removed or become water of hydration. The water may thus be present in the form of aqueous solutions of the detergent composition. The water may be provided as deionized water or as softened water.

The amount of water in the resulting alkaline composition will depend on the form of the composition (solid or liquid). For solid compositions, the amount of water may vary depending on whether the solid detergent composition is processed through forming techniques or casting (solidification occurring within a container) techniques. In general, when the components are processed by forming techniques, the solid detergent composition may include a smaller amount of water for solidification compared with the casting techniques. When preparing the solid alkaline composition by forming techniques, water may be present in ranges of between about 5.0% and about 25.0% by weight, particularly between about 7.0% and about 20.0% by weight, and more particularly between about 8.0% and about 15.0% by weight. When preparing the solid detergent composition by casting techniques, water may be present in the ranges of between about 15.0% and about 50.0% by weight, particularly between about 20.0% and about 45.0% by weight, and more particularly between about 22.0% and about 40.0% by weight.

Additional Functional Ingredients

Other active ingredients may optionally be used to improve the effectiveness of the alkaline composition. Minor amount of the additional functional ingredients may be present in the alkaline pre-soak compositions of the invention. Some non-limiting examples of such additional functional ingredients can include: additional solvents, water conditioning polymers (such as those disclosed in U.S. Publication No. 2012/0053104), additional corrosion inhibitor polymers, bleaching agents, wetting agents, threshold agents, stabilizers, soil suspending agents, colorants, fragrances, foam inhibitors, antiredeposition agents, anti-etch agents, antimicrobial agents, anti-foaming agents, solvents, pH modifier, hydrotropes and other ingredients useful in imparting a desired characteristic or functionality in the detergent composition. The following describes some examples of such ingredients.

Additional functional ingredients provide desired properties and functionalities to the compositions of the invention. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications.

Defoaming Agents

In addition to the use of certain nonionic and/or anionic surfactants, the compositions according to the invention may further include a defoaming agent. Suitable defoamers include mono- and distearyl acid phosphates, silicone oils, mineral oils, and organic carriers containing long-chain ketones (e.g. the Dehypon series, ex Henkel KGaA, Germany).

Builders or Water Conditioners

The detergent composition can include one or more building agents, also called chelating or sequestering agents (e.g., builders), including, but not limited to: a condensed phosphate, a phosphonate, an aminocarboxylic acid, or a polyacrylate. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight.

If the detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the composition as water of hydration.

Examples of phosphonates included, but are not limited to: 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), HOCH2CH2N[CH2PO(OH)$_2$]$_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), C9H(28-x)N3 NaxO15P5 (x=7); hexamethylenediamine(tetramethylenephosphonate), potassium salt, C10H(28-x)N2KxO12P4 (x=6); bis(hexamethylene)triamine(pentamethylenephosphonic acid), and $(HO_2)POCH_2N[(CH_2)_2N[CH_2PO(OH)_2]_2]_2$. A preferred phosphonate combination is ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred.

The detergent compositions can contain a non-phosphorus based builder. Although various components may include trace amounts of phosphorous, carboxylates such as citrate, tartrate or gluconate are also suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, N-hydroxyethyl-ethylenediaminetriacetic acid (HEDTA), diethylenetriaminepentaacetic acid (DTPA), and other similar acids having an amino group with a carboxylic acid substituent or their salts.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate (—CO2-) groups such as maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers.

Additional Corrosion Inhibitors

Additional corrosion inhibitors which may be optionally added to the alkaline cleaning compositions include magnesium and/or zinc. Preferably, the metal ions are provided in water soluble form. Examples of useful water soluble forms of magnesium and zinc ions are the water soluble salts thereof including the chlorides, nitrates and sulfates of the respective metals. If any of the alkalinity providing agents are the alkali metal carbonates, bicarbonates or mixtures of such agents, magnesium oxide can be used to provide the Mg ion. The magnesium oxide, at suitable pH less than about 9, is water soluble in such solutions and is a preferred source of Mg ions. In order to maintain the dispersability of the magnesium and/or zinc corrosion inhibitors in aqueous solution, and in the presence of agents which would otherwise cause precipitation of the zinc or magnesium ions, e.g., carbonates, phosphates, etc., it might be advantageous to include a carboxylated polymer to the solution.

Still further additional corrosion inhibitors can include those disclosed for example in U.S. Patent Publication Nos. 2013/0102518, 2012/0216834, 2011/0000505, 2010/0116473, 2010/0111756, 2008/0127995, 2006/0097229, 2006/0040843, 2005/0245411 and 2005/0242042, which are all herein incorporated by reference in their entirety.

Methods of Use

Methods of use according to the invention generally relate to a method of cleaning articles with a hard surface. In additional aspects, the methods of use generally relate to cleaning articles and hard surfaces that contains an alkaline sensitive metal, such as, aluminum or aluminum containing alloys. Additionally, pewter surfaces may also be treated according to the invention as this difficult to clean surface often requires hand washing to avoid the change of the silvery finish to a dark or black finish. Exemplary articles can be found in industrial plants, maintenance and repair services, manufacturing facilities, kitchens, and restaurants. Exemplary equipment having a surface containing an alkaline sensitive metals include sinks, cookware, utensils, machine parts, vehicles, tanker trucks, vehicle wheels, work surfaces, tanks, immersion vessels, spray washers, and ultrasonic baths. The methods of the invention employing the alkaline cleaning compositions can be used in environments other than inside a dishwashing machine. Alkaline sensitive metals in need of cleaning are found in several locations. Exemplary locations also include trucks, vehicle wheels, ware, and facilities. One exemplary application of the alkaline sensitive metal cleaning detergent composition for cleaning alkaline sensitive metals can be found in cleaning vehicle wheels in a vehicle washing facility. Compositions including the phosphonated oligomers may be used in any of these applications and the like.

Without being limited according to aspects of the invention, the alkaline cleaning composition of the invention is employed before a wash cycle of a dishwashing application, either outside of the dish machine (e.g. pre-soak) or inside of the dish machine (e.g. pre-wash).

In one embodiment, the methods involve providing the alkaline cleaning composition of the invention (i.e. Bricorr-containing alkaline compositions) as a pre-soak and/or pre-wash composition. In some aspects, in a traditional ware wash machine, the alkaline cleaning compositions according to the invention may be inserted into a dispenser in a dishwashing machine, forming a solution with the pre-soak composition and water, contacting the alkaline-sensitive article. For example, the alkaline cleaning composition according to the invention may contact an article in the dishwashing machine with the wash solution, and thereafter rinsing the article (and optionally employing further washing and rinsing cycles). Alternatively, the alkaline pre-soak and/or pre-wash compositions according to the invention may also be performed wholly outside of the warewash machine. Also, by using programmable single tank equipment, it is possible to apply the alkaline pre-soak step inside the machine as a separate cycle.

Generally, the methods of the present invention involves first providing the alkaline cleaning composition according to the invention as a pre-soak composition, forming a wash (or soak) solution with the alkaline cleaning composition and water, contacting a soil on an article with the wash solution, and if desired, rinsing the article.

In another embodiment, the methods of the present invention involve providing both the alkaline cleaning composition according to the invention as a pre-soak composition and employing again the alkaline cleaning compositions according to the invention in a cleaning application. When carrying out the methods of the invention, any use of the alkaline cleaning compositions as pre-soak compositions may be provided in a tank or reservoir for the soaking of articles outside of a ware wash machine. Alternatively, or in addition, alkaline cleaning compositions according to the invention can be dosed into such tank or reservoir in a concentrate and/or ready-to-use solid and/or solution.

Alternatively, the alkaline cleaning compositions according to the invention may be dispensed onto articles, such as dishes in need of cleaning and corrosion inhibition. The dispenser may be selected from a variety of different dispensers depending of the physical form of the composition. For example, a liquid composition may be dispensed using a pump, either peristaltic or bellows for example, syringe/plunger injection, gravity feed, siphon feed, aspirators, unit dose, for example using a water soluble packet such as polyvinyl alcohol, or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example using a water soluble packet such as polyvinyl alcohol or a foil pouch, evacuation from a pressurized chamber, or diffusion through a membrane or permeable surface. Finally, if the composition is a solid or powder, the composition may be dispensed using a spray, flood, auger, shaker, tablet-type dispenser, unit dose using a water soluble packet such as polyvinyl alcohol or foil pouch, or diffusion through a membrane or permeable surface. The dispenser may also be a dual dispenser in which one component, such as the alkaline component (e.g. fatty acid soap), is dispensed on one side and another component, such as an optional surfactant or antimicrobial agent, and is dispensed on another side. These exemplary dispensers may be located in or associated with a variety of dish machines including under the counter dish machines, bar washers, door machines, conveyor machines, or flight machines. The dispenser may be located inside the dish machine, remote, or mounted outside of the dishwasher. A single dispenser may feed one or more dish machines.

The alkaline cleaning compositions according to the invention may be employed in use solutions and/or concentrates, wherein generally water is added to generate a solution. The water may be any type of water, preferably hard water. Hard water is often characterized as water containing a total dissolved solids (TDS) content in excess of 200 ppm. This type of water is often referred to as high solids containing water. In certain localities, the water contains a total dissolved solids content in excess of 400 ppm, and even in excess of 800 ppm. In certain embodiments hard water can be defined as having 15 grains or more per gallon. In preferred aspects of the methods of the invention, the water is preferable warm, such as a temperature above room temperature. The most preferred wash solution is one that maintains the preferred pH ranges of at least about 8, or more preferably a pH range of at least about 9. The alkaline cleaning compositions according to the invention may contact the soil in a number of ways including spraying, dipping, immersing, sump-pump solution, clean in place and/or misting.

Once contacted for a sufficient period of time, the stains on the article in need of cleaning and corrosion inhibition are loosened and/or removed from the article. In some aspects the wares need to be "soaked" for a period of time for the alkaline pre-soak to penetrate the stains. In some aspects, the contacting step such as submerging the ware or substrate in need of stain removal further includes the use of warm water to form the pre-soak solution in contact with the stains for at least a few seconds, preferably at least about 45 seconds to 24 hours, preferably at least about 45 seconds to 6 hours, and more preferably for at least about 45 seconds to 1 hour. In some aspects, wherein the pre-soak is applied within a warewash machine, the soaking period of time may be from about 2 seconds to 20 minutes in an institutional machine, and optionally longer in a consumer machine. In a preferred aspect, the pre-soak is applied (e.g. ware is soaked in the alkaline fatty acid soap solution) for a period of at least 60 seconds, preferably at least 90 seconds. Beneficially, the soaking of ware or stained articles according to the invention does not require agitation; however, use of agitation may be employed for further removal of soils.

As one skilled in the art will ascertain from the disclosure of the invention, the method can include more steps or fewer steps than laid out here.

Methods of Manufacture

The alkaline compositions of the present invention can be formed by combining the components in the weight percentages and ratios disclosed herein. The alkaline compositions may be provided as a solid, as a liquid concentrate, and/or as a use solution constituting an aqueous solution or dispersion of the concentrate. Such use solutions may be formed during the warewashing processes.

Solid alkaline detergent compositions formed using the solidification matrix are produced using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

Specifically, in a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid form", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition.

In general, it is expected that the detergent composition will remain in solid form when exposed to temperatures of up to approximately 100° F. and particularly greater than approximately 120° F.

The resulting solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the solidification matrix have a weight of approximately 100 grams or greater, and solid block detergents formed by the solidification matrix have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use. Alternatively, the solid alkaline detergent composition is provided in the form of a unit dose, typically provided as a cast solid, an extruded pellet, or a tablet having a size of between approximately 1 gram and approximately 50 grams. In another alternative, multiple-use solids can be provided, such as a block or a plurality of pellets, and can be repeatedly used to generate aqueous detergent compositions for multiple cycles.

In use, the detergent composition may be diluted with water to form use compositions or solutions. The typical dilution factor is between approximately 1 and approximately 10,000 but will depend on factors including water hardness, the amount of soil to be removed and the like. In an embodiment, the concentrate is diluted at a ratio of between about 1:10 and about 1:10000 concentrate to water. Particularly, the concentrate is diluted at a ratio of between about 1:100 and about 1:5000 concentrate to water. More particularly, the concentrate is diluted at a ratio of between about 1:250 and about 1:2000 concentrate to water. Accordingly, the concentration of the individual components in the use solution will be significantly lower than for the concentrated form of the detergent composition.

For example, the use solution may have an active component concentration of between about 40 and about 8,000 parts per million (ppm), more particularly, between approximately 200 and approximately 3,000 ppm, even more particularly, from about 400 to about 2000 ppm.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Evaluations were conducted to determine optimal concentration of the mixture of phosphono ethane carboxylates (commercially available as Bricorr 288) required to minimize precipitate in solution. The evaluated phosphonated oligomer is potentially advantageous for protecting aluminum surfaces. A polymer solution of 2.5 g Bricorr 288 (40% active) in 100 mL $H_2O$ was prepared; 1 mL polymer solution provides 10 ppm Bricorr 288 in 1000 mL $H_2O$. Solutions were prepared in beakers having the concentrations shown below in Table 2 and evaluated for percentage transmittance at varying temperatures (85° F., 140° F., and 160° F.) upon the addition of sodium hydroxide.

Corrosion protectant employed: Bricorr® 288: tetrasodium phosphonoethane-1,2-dicarboxylate and hexasodium phosphonobutane-1,2,3,4-tetracarboxylate (CAS No. 143239-08-1), commercially-available from Rhodia.

The measurements were obtained from beaker testing wherein the beakers of solutions were placed on a heat plate and stirred according to the following procedures:

Using four 1000 or 1500 ml beakers, 1000 mL of DI water is added and 1½" stir bar to each before heating. Add 5.00 mL sodium bicarbonate solution to each beaker and when water temperature reaches 85° F., add hardness solution to each, 1 ml=2 grains, running in increments of 2 grains. Then add 4.00 mL of sample to each beaker (equal to 0.40% or 1 ounce/2 gallons). After sample is completely mixed, turn off stirrer. When temperature reaches 85° F., take initial reading (0 minutes). After the sample was completely mixed into the beaker, a transmittance measurement was taken at 560 nm, at 85° F., 140° F., and 160° F.

TABLE 2

| ppm Bricorr 288 | Temp (° F.) | % Transmittance |
|---|---|---|
| 20 ppm | 85 | 97.9 |
| | 140 | 96.8 |
| | 160 | 91.8 |
| 30 ppm | 85 | 97.2 |
| | 140 | 95.9 |
| | 160 | 92.9 |
| 40 ppm | 85 | 97.2 |
| | 140 | 95.9 |
| | 160 | 94.5 |
| 50 ppm | 85 | 97.0 |
| | 140 | 96.1 |
| | 160 | 94.2 |
| 60 ppm | 85 | 96.9 |
| | 140 | 95.5 |
| | 160 | 93.1 |
| 80 ppm | 85 | 96.3 |
| | 140 | 94.7 |
| | 160 | 92.0 |

Figure 2:
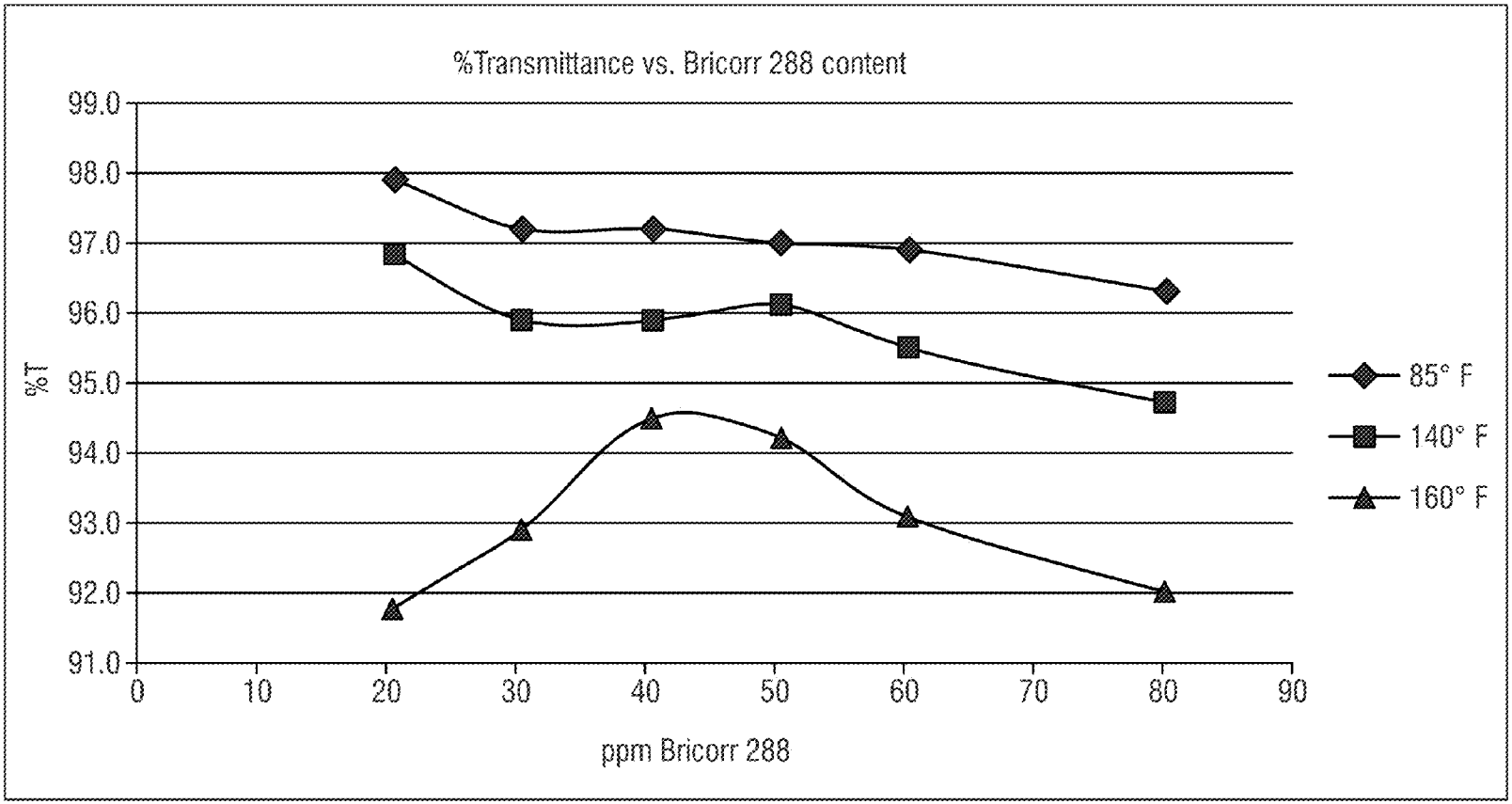
FIG. 2 shows the percentage transmittance of solutions at increasing concentrations of phosphonated oligomers (Bricorr 288) according to embodiments of the invention.

From the results shown in Table 2 above and the results depicted in FIGS. 1-2, a 40 ppm concentration of the Bricorr 288 solution was selected for further evaluation in combination with a crystal modifying component for evaluation of aluminum protection.

Example 2

The Bricorr 288 40 ppm composition from Example 1 was further analyzed in combination with a copolymer of AMPS and acrylic acid (AR545) for evaluation of the impact of the combination on precipitation when adding increasing concentrations of the crystal modifying component AR545, again in beaker evaluations using the procedures set forth in Example 1. The Bricorr 288 phosphonated oligomer polymer was added to a beaker to provide 40 ppm. Beakers were then formulated to provide the AR545 concentrations in solution as set forth in Table 3 below.

Additional polymer employed: Aquatreat AR 545 (abbreviated AR 545): copolymer of 2-Acrylamido-2-methylpropane sulfonic acid (AMPS) and acrylic acid, commercially-available from Akzo Nobel.

After the sample was completely mixed into the beaker, a transmittance measurement was taken at 560 nm, at 85° F., 140° F., and 160° F. and results are shown in Table 3.

TABLE 3

| ppm AR545 | Temp (° F.) | % Transmittance |
|---|---|---|
| 20 ppm | 85 | 96.0 |
| | 140 | 94.7 |
| | 160 | 93.3 |
| 30 ppm | 85 | 95.8 |
| | 140 | 94.5 |
| | 160 | 93.2 |
| 40 ppm | 85 | 96.5 |
| | 140 | 94.7 |
| | 160 | 93.2 |
| 50 ppm | 85 | 97.4 |
| | 140 | 95.2 |
| | 160 | 94.3 |
| 60 ppm | 85 | 99.2 |
| | 140 | 98.5 |
| | 160 | 98.0 |
| 80 ppm | 85 | 100.0 |
| | 140 | 100.0 |
| | 160 | 99.9 |

Figure 3:
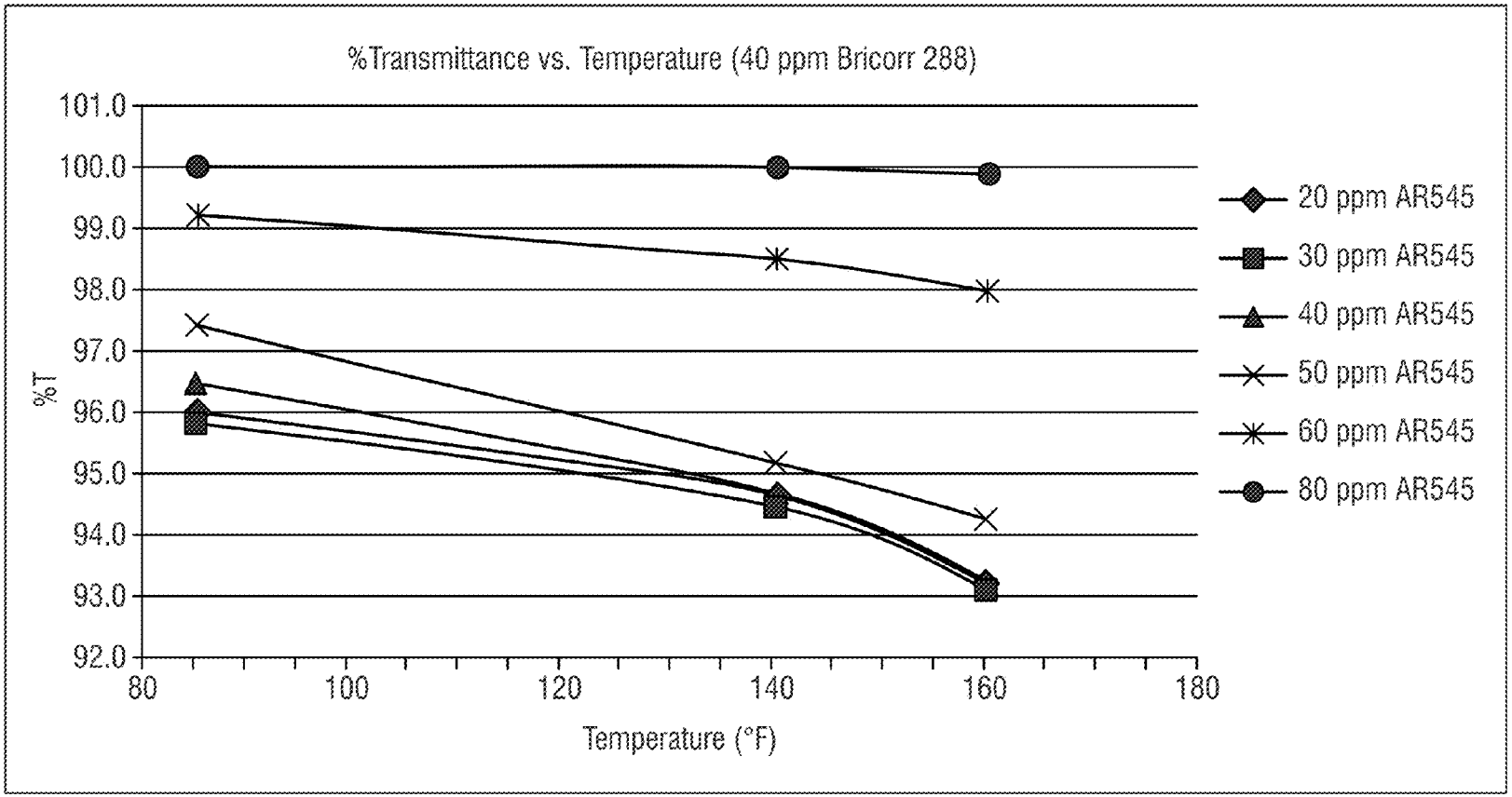
FIG. 3 shows the percentage transmittance of solutions at increasing temperatures according to embodiments of the invention employing phosphonated oligomers (Bricorr 288) in combination with varying concentrations of a copolymer of AMPS and acrylic acid (AR545) to measure precipitate levels.
Figure 4:
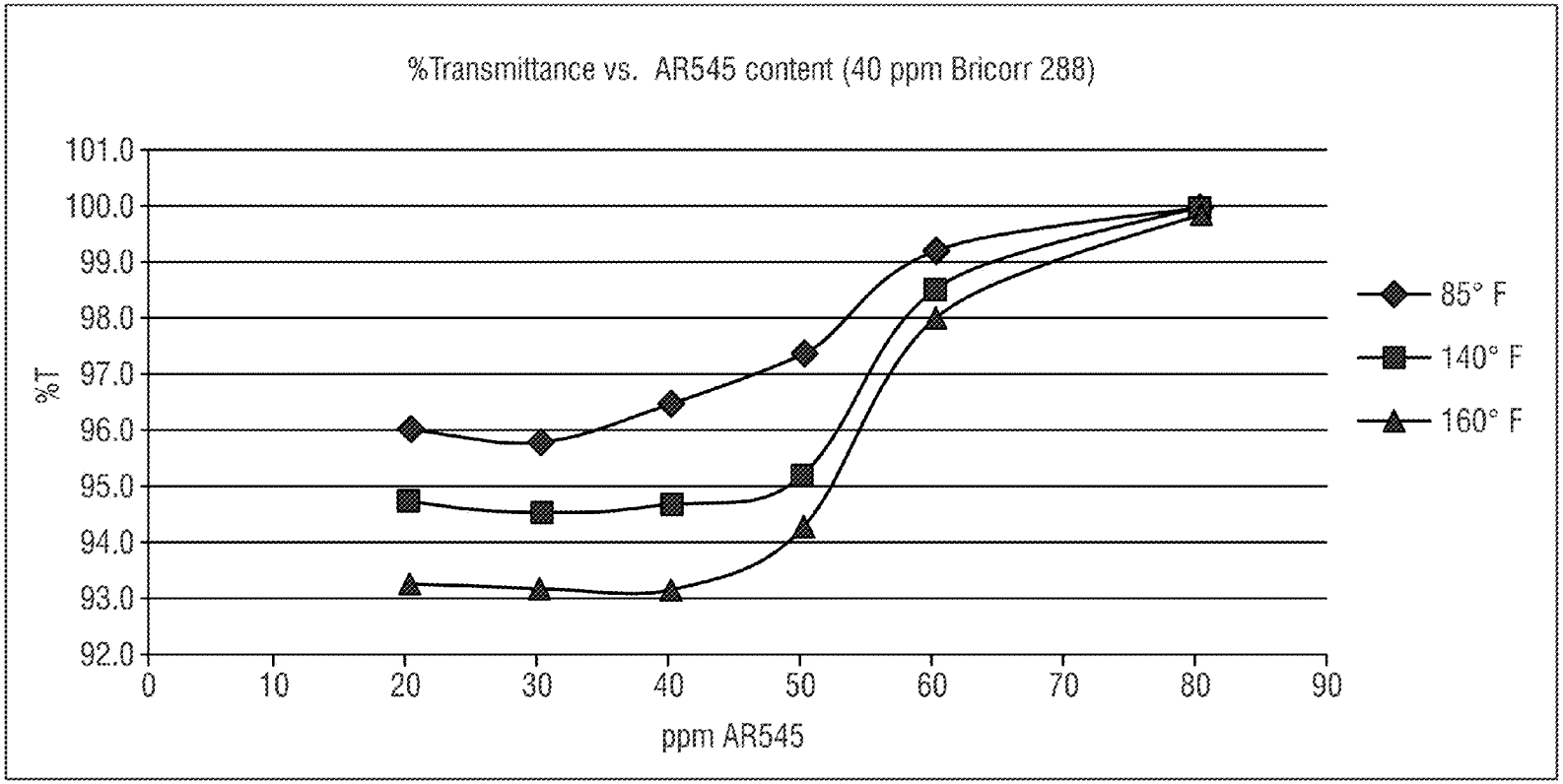
FIG. 4 shows the percentage transmittance of solutions at increasing concentrations of the copolymer of AMPS and acrylic acid (AR545) in combination with the phosphonated oligomers (Bricorr 288) according to embodiments of the invention levels.

From the results shown in Table 3 above and the results depicted in FIGS. 3-4, the AR545 is able to control precipitation very well, either alone or in combination with the Bricorr 288. A 40 ppm concentration of both the Bricorr 288 and AR545 was selected for further evaluation in treating metal surfaces with alkaline sensitivity.

Example 3

Solutions of 40 ppm concentration of both Bricorr 288 and AR545 were further evaluated in combination with citric acid to determine whether additional precipitate control can be achieved, employing the beaker evaluations using the procedures set forth in Example 1.

After the sample of Bricorr 288, AR545 and citric acid was completely mixed into the beaker, a transmittance measurement was taken at 560 nm, at 85° F., 140° F., and 160° F. The results are shown in Table 4

TABLE 4

| Temp (° F.) | % Transmittance |
|---|---|
| 85 | 99.3 |
| 140 | 98.6 |
| 160 | 98.1 |

Observation from the evaluation of the solutions containing Bricorr 288, AR545 and 150 ppm citric acid indicate that no discernible solids precipitated at any point in the experiment. In addition, there were no solid present once solutions were cooled to room temperature.

Example 4

Evaluation was conducted to determine how well the phosphonated oligomer Bricorr 288 protects an aluminum surface. The following procedure was employed:

1) Take 1000 mL DI water in a beaker, with 350 ppm NaOH
2) Aluminum 1100 alloy coupons (1"×3")—wash with a neutral detergent, DI water, then rinse with acetone. (3 coupons needed for each test)
3) Heat $H_2O$/NaOH solution to 160° F.
4) Weigh each coupon, record weight
5) Using tongs, hold the first coupon in the NaOH solution for 1 minute. Repeat washing process after removal from solution, and weigh again.
   Repeat for second coupon (5 minute solution) and third coupon (10 minutes)
6) Add 40 ppm Bricorr 288 to solution, and repeat procedure (steps 1-5) with fresh coupons The results are shown in Table 5 for NaOH solution alone (without the phosphonated oligomer) and Table 6 for NaOH with the phosphonated oligomer. For 1, 5, and 10 minute intervals, the solution bubbled consistently for the full duration the coupon was submerged, indicating constant reaction of the NaOH with the aluminum. The % mass lost is fairly consistent between the two solutions, with and without Bricorr 288 in solution. The researcher identified slight differences in the aluminum coupons (e.g. masses, existing scratches from aluminum cutting) which are expected to result in different surface areas on which the NaOH can act.

TABLE 5

| 350 ppm NaOH | | |
|---|---|---|
| Time (min) | Mass (g) | |
| 1 | Before | 8.4607 |
| | After | 8.4580 |
| | % Change | 0.0319 |
| 5 | Before | 8.4935 |
| | After | 8.4767 |
| | % Change | 0.1978 |
| 10 | Before | 8.4906 |
| | After | 8.4609 |
| | % Change | 0.3498 |

TABLE 6

| 350 ppm NaOH, 40 ppm Bricorr 288/80 ppm Bricorr 288 | | |
|---|---|---|
| Time (min) | Mass (g) | |
| 1 | Before | 8.4401 |
| | After | 8.4372 |
| | % Change | 0.0344 |
| 5 | Before | 8.4677 |
| | After | 8.4505 |
| | % Change | 0.2034 |
| 10 | Before | 8.4616 |
| | After | 8.4279 |
| | % Change | 0.3983 |

The results show that even with the Bricorr 288 added to a caustic solution, at all of 1, 5, and 10 minute intervals the solution bubbled consistently for the full duration that the coupon was submerged. The 1 minute and 5 minute samples were done with 40 ppm Bricorr in the solution. When it was observed that the Bricorr didn't seem to be preventing the attack of the NaOH on the aluminum, the concentration of Bricorr was increased to a total 80 ppm for the 10 minute sample. The 10 minute sample seemed to be slower to start bubbling, but ultimately bubbled with the same vigorousness as the other samples with lower Bricorr concentration.

Figure 5:
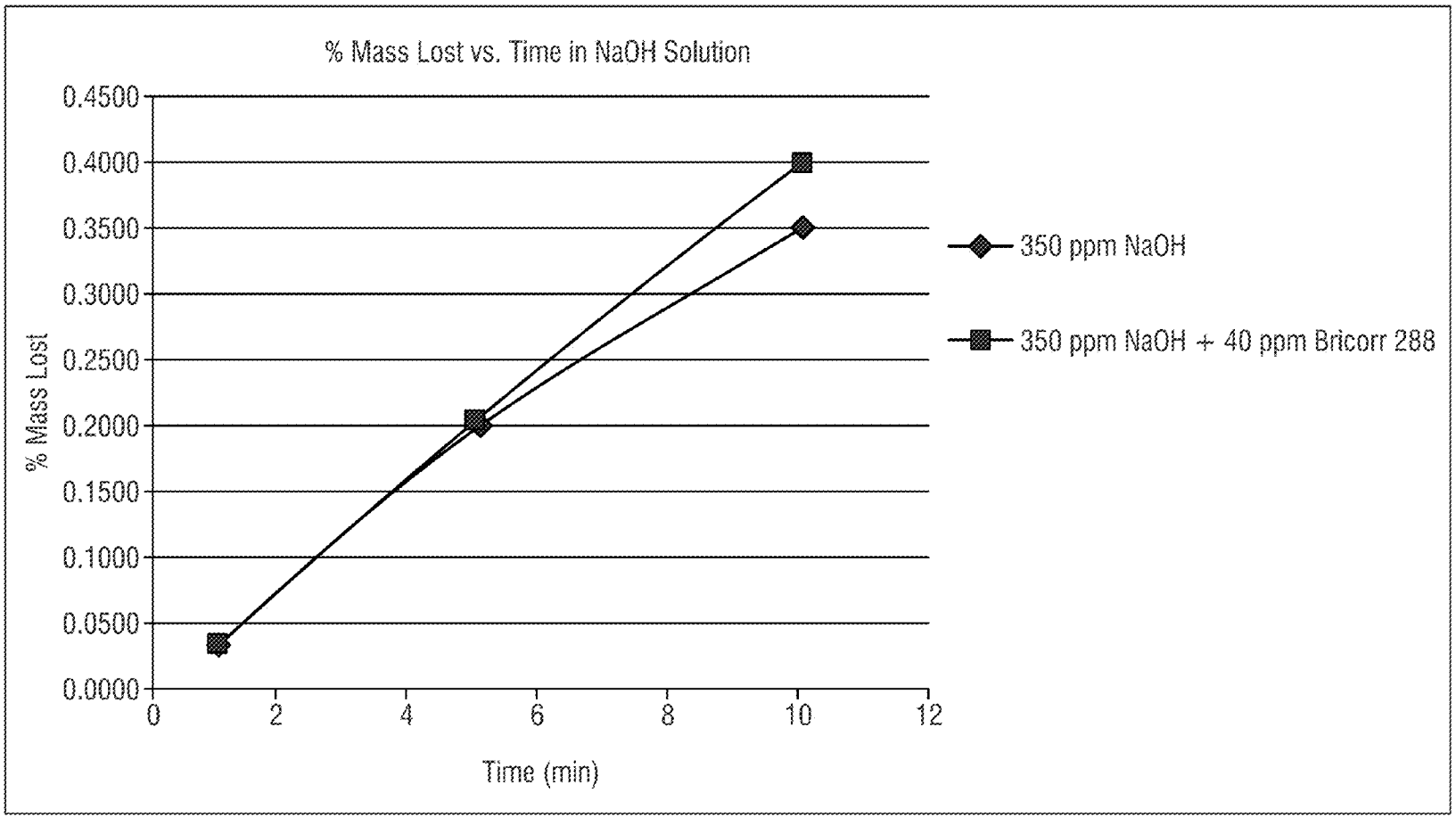
FIG. 5 shows the percentage mass loss of a metal surface evaluated over time in caustic solution when employing a phosphonated oligomer (Bricorr 288) according to embodiments of the invention in comparison to caustic solutions without the polymer.

As a result of this experiment it was concluded that Bricorr 288 alone in DI water insufficiently prevents the attack of NaOH on aluminum as the loss of mass is nearly identical with and without the presence of the polymer. These results are further shown in FIG. 5, wherein the percentage of mass lost over time in the caustic solution shows a requirement of additional components. As a result, the same testing is to be repeated in presence of hardness to determine whether this will reduce the strength of the NaOH and allow the Bricorr to form a passivating layer on the aluminum surface.

Example 5

Additional testing of the ability of the phosphonated oligomer Bricorr 288 to protect aluminum using hardened water (17 grain) was conducted. The methods of Example 4 were repeated with additional components added to beaker as follows: in addition to NaOH (350 ppm), 17 grain (8.5 ml) hardness solution, 5 ml $NaHCO_3$ solution, and components to control precipitation, as determined in beaker tests 40 ppm Bricorr 288, 40 ppm AR545, 100 ppm citric acid.

An initial analysis forgot to add sodium bicarbonate solution, which resulted in $Mg(OH)_2$ precipitating out early. The solution was re-mixed and also increased citric acid concentration to 150 ppm when re-mixing, to further ensure that $Mg(OH)_2$ formation would be controlled. All results are from solution with 150 ppm citric acid and shown in Table 7.

TABLE 7

| 350 ppm NaOH, 40 ppm Bricorr 288, 17 grain hardness solution, 5 ml NaHCO3, 40 ppm AR545, 150 ppm citric acid | | |
|---|---|---|
| Time (min) | Mass (g) | |
| 1 | Before | 8.4528 |
| | After | 8.4530 |
| | % Mass Lost | −0.0024 |
| 5 | Before | 8.4653 |
| | After | 8.4640 |
| | % Mass Lost | 0.0154 |
| 10 | Before | 8.4834 |
| | After | 8.4790 |
| | % Mass Lost | 0.0519 |

Some bubbles (although significantly fewer than the DI water/Bricorr combination) were observed. There was a small gain in mass after 1 minute (within error of analytical balance). A precipitate formed during the 10 minute sample which was not otherwise explained; the precipitate looked like the $Mg(OH)_2$ (white, fluffy gel). The beaker was clear after 5 minute sample—gradually developed during the 10 minute sample. The measured % T just after 1 minute sample—% T=99.2 (extra citric acid improved this over previous experiment); measured % T just after 10 minute sample—% T=97.0 (visible precipitate in the beaker).

Figure 6:
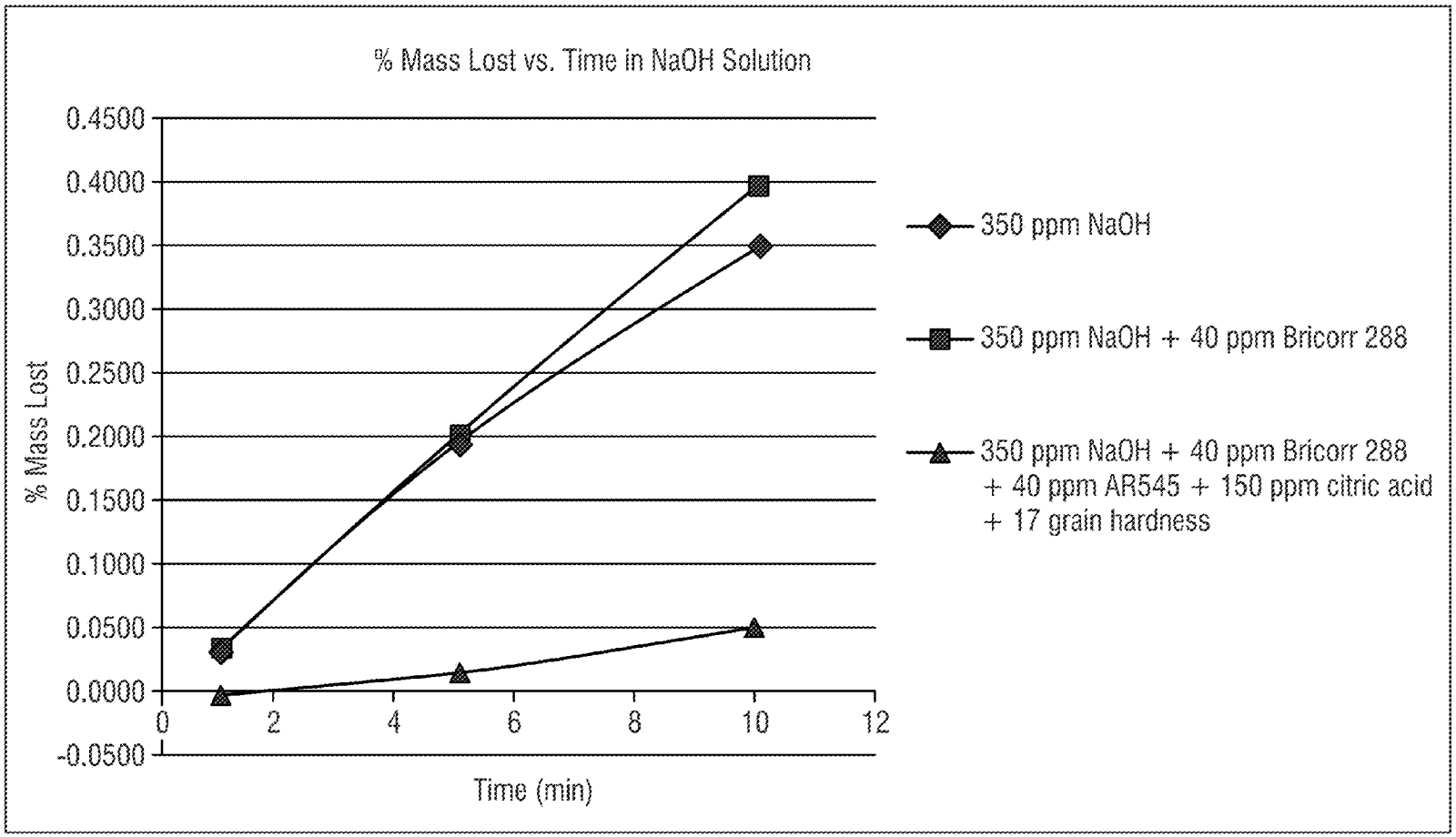
FIG. 6 shows the percentage mass loss of a metal surface evaluated over time in caustic solution when employing a phosphonated oligomer (Bricorr 288) with and without formulations containing of a copolymer of AMPS and acrylic acid (AR545) and citric acid according to embodiments of the invention in comparison to caustic solutions without the polymer.
Figure 7:
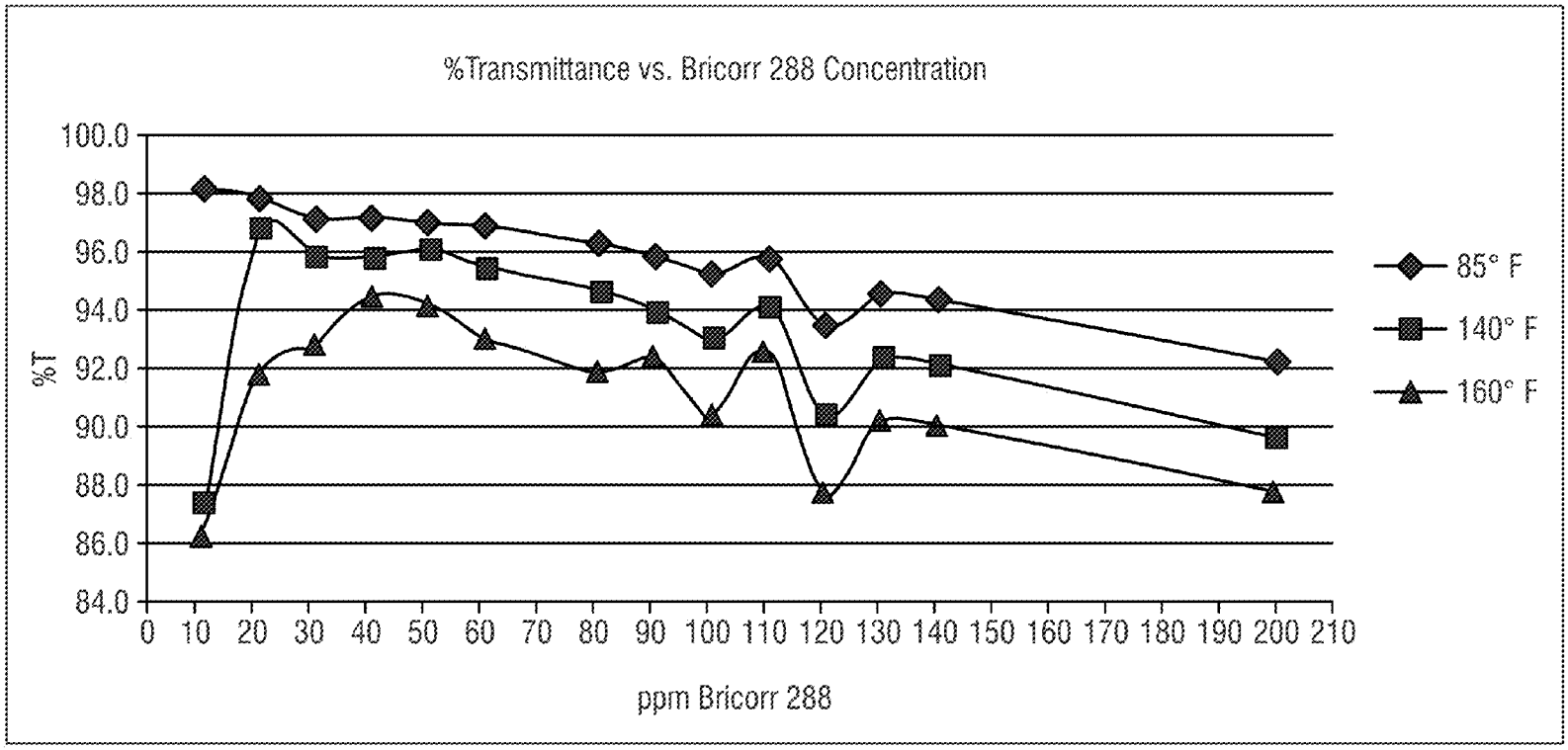
FIG. 7 shows the percentage transmittance of solutions at increasing concentrations of the phosphonated oligomers (Bricorr 288) according to embodiments of the invention.

The results are further shown in FIG. 6, wherein the percentage of mass lost over time in the caustic solution shows a significant improvement with the addition of both Bricorr 288 and AR545 in a hard water solution.

The results indicate that in the presence of hardness, the phosphonated oligomer Bricorr 288 protects the aluminum surface from losing mass. At 10 minutes, there is very little weight loss but the aluminum coupon is much whiter in appearance, indicating that something is changing with the surface even if it is not being etched away by NaOH. The quick % T measurement of the solution indicates that 150 ppm is a better amount to add to the mixture than 100 ppm—by observation and by measurement, the solution was clearer at 160° F. with the additional citric acid present.

Example 6

A block solid was formulated using the formulation determined in previous Experiments. For utilization in the ware washing machine approximately 1 kg block was produced.

Amount of each component required per liter of water: Formula: 40 ppm Bricorr 288 (40 ppm→40 mg/L of solid polymer), 40 ppm AR545 (40 ppm→40 mg/L of solid polymer), 150 ppm citric acid (150 ppm→150 mg/L), with 350 ppm NaOH (350 mg). Bricorr 288 is 40% active solid, so 40 mg/0.4→100 mg total to get 40 ppm solid. AR545 is 45% active solid, so 40 mg/0.45→88.89 mg total to get 40 ppm solid. To get citric acid, sodium citrate was added to water; MW citric acid=206.15 g/mol, MW sodium citrate $2H_2O$=308.12 g/mol; 150 mg*(308.12/206.15)=224.20 mg sodium citrate.2H20 to get 150 ppm citric acid. The formulation provides a Total=763.09 mg per L of water.

100-Cycle Machine Testing using Light Box Grading evaluated various compositions using the following methodology.

Six Libbey heat resistant glass tumblers and one Cambro Newport plastic tumbler were placed on a Raburn glass rack, which was placed in a Hobart AM-15 institutional dishwasher machine. The machine was then filled with water, which was tested for water hardness (16 grain water). The tank heaters were then turned on and wash/rinse cycles were run at 150-160° F. and 175-190° F., respectively. During the wash cycle, the machine controller was set to dispense the detergent composition Samples in the appropriate amount to achieve the detergent component concentrations indicated in the Tables below. Titrations were run to confirm that concentrations were correct. The foregoing cycle was run 100 times for each Sample.

To standardize the way that the glassware run in the 100 cycle test is evaluating using an analytical method—the light box grading. The method is based on the use of an optical system consisting of a photographic camera, a light box, a light source and a light meter. The system is controlled by a computer program (Spot Advance and Image Pro Plus). The glass to be evaluated is placed on the light box resting on its side, the intensity of the light source is adjusted to a predetermined value with the help of the light meter, and the conditions for the 100 cycle test are set on the computer. A picture of the glass is taken with the help of the camera and it is save on the computer for it analysis by the program. The picture is analyzed using the upper half of the glass on the picture to avoid the gradient of darkness on the film from the top of the glass to the bottom, due to the shape of the glass. The computer will show a histogram and will calculate its area. The area under the graph is proportional to the thickness of the deposited film.

Generally, a lower light box rating indicates that more light is able to pass through the glass. Thus, the lower the glass rating, the more effective the composition is at preventing scale on the surface on the glass. Light box evaluation of a clean, unused glass has a light box score of approximately 12,000 which corresponds to a score of 72,000 for the sum of the six glasses. Light box evaluation of a clean, unused plastic tumbler has a light box of approximately 25,000. The minimum the obtainable score for 6 glasses and one plastic tumbler is approximately 97,000.

Evaluated Compositions are set forth in Table 8. Citric acid was added as trisodium citrate and the shown concentration in Table 8 is the concentration of the citrate expressed as citric acid.

TABLE 8

| | Testing Scale Inhibiton | | | | | | |
|---|---|---|---|---|---|---|---|
| | I | II | III | IV | V | VI | VII |
| Bricorr 288 | 40 | 5 | 10 | 10 | 15 | 25 | 30 |
| Aquatreat AR 545 | 40 | 40 | | 40 | | | |
| Acumer 2000 | | | 40 | 40 | | 40 | |
| Citric Add | 150 | 150 | 150 | 150 | 150 | 150 | 150 |
| NaOH | 350 | 350 | 350 | 350 | 350 | 350 | 350 |
| # Cycles | 100 | 100 | 100 | 100 | 100 | 100 | 100 |
| Scaling | No | Yes | Yes | Yes | Yes | Yes | Yes |
| Water Hardness | 17 | 17 | 17 | 17 | 17 | 17 | 17 |
| Note | Scaling decrease as concentration of Bricorr increases | | | | | | |

A visual analysis, using a light, for the formulations set forth in Table 8 indicated a decrease in scaling as the concentration of Bricorr increased. There was no scaling after 100 cycles for all glasses treated with formula I; similarly there was no corrosion on any glasses treated with formula I.

Example 8

The efficacy of the phosphonated oligomer Bricorr 288 formulation in various concentration use solutions were tested on a pewter surface in a ware wash machine. 30 cycles at 350 ppm NaOH were conducted using a water hardness of 16 grain. The formulations and results are set forth in Table 9.

TABLE 9

| | Testing Pewter | | |
|---|---|---|---|
| Bricorr 288 | 40 | 50 | 50 |
| Aquatreat AR 545 | 40 | 40 | 40 |
| Acumer 2000 | | | |
| Citric Acid | 150 | 150 | 150 |
| NaOH | 350 | 350 | 350 |
| # Cycles | 30 | 30 | 30 |
| Pewter Plate | Dull and Dark | Slightly Dull | Shiny |
| Water Hardness | 16 | 15 | 14 |
| Note | Not Acceptable | Acceptable | Acceptable |

The results shown as not acceptable included the darkening and/or dulling of the surface. The results indicate that the use of the Bricorr in formulations beneficially retains the shiny appearance, confirming the benefit of the increased ppm of Bricorr 288 and combination with the additional components according to embodiments of the invention.

Example 9

Additional verification of previous tests using the phosphonated oligomer Bricorr 288 formulation was conducted in a ware wash machine for 100 cycles using aluminum pan. The tested water hardness was 16 grains. The formulations and results are set forth in Table 10.

TABLE 10

| | Testing Aluminum Corrosion | | |
|---|---|---|---|
| Bricorr 288 | 40 | 40 | 51.43 |
| Aquatreat AR 545 | 40 | 40 | 51.43 |
| Acumer 2000 | | | |
| Citric Acid | 150 | 150 | 192.86 |
| NaOH | 350 | 350 | 450 |
| # Cycles | 100 | 100 | 100 |
| Aluminum protection | Excellent | Good | Acceptable |
| Initial Weight, g | 389.67 | 394.40 | 380.62 |
| Final Weight, g | 389.51 | 394.28 | 380.54 |
| Difference, g | 0.16 | 0.12 | 0.08 |
| Water Hardness | 17 | 16 | 16 |
| Note | Some Bluing | Few Brown and Yellowing | Few White Blue Spots |
| | No scaling on glasses or machine | | |

Example 10

Additional testing of alternative polymers was conducted to determine suitable polymers for the alkaline corrosion inhibiting compositions according to the invention. Beaker testing was conducted to determine suitable polymer replacements for AR545.

Acumer 2000, which contains the same polymeric components as the AR545 (same acrylic acid/AMPS content and ratio as AR545), is capable of controlling hardness as a formulation replacement for AR545. The formulation included: 5 ppm Bricorr 288—0.5 mL solution of 2.5 g Bricorr 288 (40% active)/100 mL water; 40 ppm Acumer 2000—4 mL solution of 2.33 g Acumer 2000 (43% active)/100 ml water; 150 ppm citric acid—7.5 mL solution containing 3.06 g sodium citrate.$2H_2O$/100 mL water; 350 ppm NaOH—5 mL solution containing 14 g 50% NaOH solution/100 mL water.

The measured transmittance values were 100% at both 85° F. and 160° F.

Example 11

Soil Test: The cleaning efficacy of Bricorr 288 compositions were evaluated at 30 ppm and 35 ppm concentrations using a 50 cycle institutional ware wash methodology in 15 grain water. To test the ability of compositions to clean glass and plastic, twelve 10 oz. Libby heat resistant glass tumblers and 5 plastic tumbler were used. Six of the glass tumblers were cleaned. A hot point soil was made, consisting of: 2 cans of Dinty Moore Beef stew (1360 g), 1 large can of tomato sauce (822 g), 15.5 sticks of Blue Bonnet Margarine (1746 g), and Powdered milk (436.4 g). A soup mixture was made consisting of: 1:1 (v:v) mixture of Campbell's Cream of Chicken Soup: Kemp's Whole Milk.

Procedure:

1) Soil the glass and plastic tumblers by rolling the glasses 3 times in 1:1 (v/v) mixture of Campbell's Cream of Chicken Soup: Kemp's Whole Milk. Place the glasses in the oven at 160° F. for 8 minutes.
2) While glasses are drying in the over, prime the warewash machine with 120 g of hot point soil. This corresponds to ~2000 ppm of food soil in the sump
3) Place the 12 glasses/4 tumblers in a rack as follows, with an additional plastic tumbler in the top left corner of the rack (with respect to the glasses as shown above) which is used to load the hot point soil into the machine:

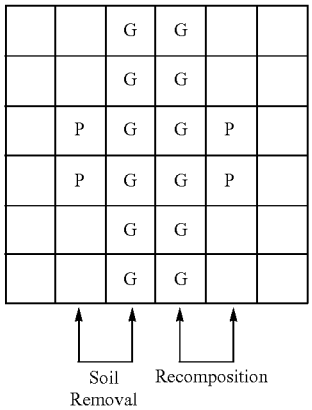

4) Run one cycle of the machine
5) When the cycle has ended, mop the top of the glasses with a dry paper towel
6) Remove the glasses/tumblers that had previously been rolled in the soup/milk mixture, and repeat the soiling procedure as described in step 1.
7) Reload the wash tank back to original soil level, to compensate for the dilution in the tank from the addition of the rinse water. For machine A3, which has a 14 gal (~53 L) tank, and a 0.74 gal (~2.8 L) rinse, 6.35 g of hot point soil are added after each cycle
8) Complete 7 cycles in the machine, re-soiling the glasses and reloading the machine sump with soil after each cycle
9) Stain for protein (Coomassie Blue) and fat (Sudan 4) and image to see how much residue was left on the glass after the 7 cycles. Half of each the soil/redeposition glasses are stained in each color dye.

After staining, there was very little fat residue visible on any of the glasses, though a small amount was present near the rim of the redeposition glasses. It was visible to the naked eye that there was a slightly more red color, on the redeposition glasses than on the soiled glasses. The redeposition glasses were essentially free of protein residue, with very slightly blue color present. The soiled glasses, however, had some minor blue spotting, indicating some protein residue remaining.

The results for the various evaluated formulations are shown in Tables 11-12.

TABLE 11

(30 ppm Bricorr, 50 ppm Acumer 2000, 150 ppm citric acid, and 350 ppm NaOH)

| Glass # | Area | Mean | StdDev | Min | Max | Median |
|---|---|---|---|---|---|---|
| 1 | 47664 | 24695.362 | 2758.428 | 16447 | 65535 | 25023 |
| 2 | 47664 | 33085.038 | 4666.283 | 20543 | 65535 | 33599 |
| 3 | 47667 | 30946.799 | 3456.337 | 17151 | 65535 | 31615 |
| 4 | 47664 | 24125.427 | 2689.309 | 14463 | 65535 | 24383 |
| 5 | 47664 | 30781.939 | 4143.208 | 20031 | 65535 | 30783 |
| 6 | 47664 | 28830.79 | 3486.829 | 19007 | 65535 | 29503 |
| Average | | 28744.226 | 3533.399 | 17970 | 65535 | 29151 |
| Min | | 24125.427 | 2689.309 | 14463 | 65535 | 24383 |
| Max | | 33085.038 | 4666.283 | 20543 | 65535 | 33599 |

TABLE 12

(30 ppm Bricorr, 40 ppm Acusol 588, 150 ppm sodium citrate, and 350 ppm NaOH)

| Glass # | Area | Mean | StdDev | Min | Max | Median |
|---|---|---|---|---|---|---|
| 1 | 47664 | 23356.722 | 2702.354 | 14399 | 65535 | 23615 |
| 2 | 47664 | 26568.767 | 2787.787 | 17599 | 65535 | 26559 |
| 3 | 47667 | 27348.894 | 3000.256 | 18559 | 65535 | 27391 |
| 4 | 47664 | 23299.553 | 2615.205 | 14655 | 65535 | 23423 |
| 5 | 47664 | 23491.44 | 2665.656 | 15807 | 65535 | 23679 |
| 6 | 47664 | 22502.141 | 2713.596 | 13503 | 65535 | 22783 |
| Average | | 24427.920 | 2747.476 | 15754 | 65535 | 24575 |
| Min | | 22502.141 | 2615.205 | 13503 | 65535 | 22783 |
| Max | | 27348.894 | 3000.256 | 18559 | 65535 | 27391 |

Example 12

100-Cycle Machine Test: The testing of Example 11 (including the same glass orientation within the machine) was repeated using a 5 ppm increase in concentration of the Bricorr. The tested formulations are set forth in Tables 13-14 with the results for each formulation. Overall, the scale on the glasses was very minimal. Because of how good the glasses looked, a pan was also run through the machine for 50 cycles (As many cycles as were possible with the remaining quantity of detergent).

TABLE 13

(35 ppm Bricorr, 40 ppm Acusol 588, 150 ppm $Na_3$ Citrate, and 350 ppm NaOH)

| Glass # | Area | Mean | StdDev | Min | Max | Median |
|---|---|---|---|---|---|---|
| 1 | 47664 | 22715.679 | 2723.086 | 13247 | 65535 | 23103 |
| 2 | 47664 | 27320.966 | 3234.765 | 16255 | 65535 | 27647 |
| 3 | 47667 | 27825.227 | 2753.273 | 18495 | 65535 | 28031 |
| 4 | 47664 | 23434.597 | 2599.599 | 14527 | 65535 | 23615 |
| 5 | 47664 | 24296.415 | 2940.632 | 15999 | 65535 | 24511 |
| 6 | 47664 | 24767.403 | 2830.538 | 13823 | 65535 | 24895 |
| Average | | 25060.048 | 2846.982 | 15391 | 65535 | 25300 |
| Min | | 22715.679 | 2599.599 | 13247 | 65535 | 23103 |
| Max | | 27825.227 | 3234.765 | 18495 | 65535 | 28031 |

TABLE 14

(35 ppm Bricorr, 50 ppm Acumer 2000, 150 ppm sodium citrate, and 350 ppm NaOH)

| Glass # | Area | Mean | StdDev | Min | Max | Median |
|---|---|---|---|---|---|---|
| 1 | 47664 | 23313.502 | 2654.574 | 13183 | 65535 | 23487 |
| 2 | 47664 | 23192.637 | 2613.465 | 14399 | 65535 | 23359 |
| 3 | 47667 | 27661.538 | 2602.95 | 17663 | 65535 | 27775 |
| 4 | 47664 | 23546.411 | 2640.919 | 14527 | 65535 | 23871 |
| 5 | 47664 | 23166.371 | 2684.407 | 14591 | 65535 | 23487 |
| 6 | 47664 | 23615.473 | 2810.057 | 14527 | 65535 | 23871 |
| Average | | 24082.655 | 2667.729 | 14815 | 65535 | 24308 |
| Min | | 23166.371 | 2602.95 | 13183 | 65535 | 23359 |
| Max | | 27661.538 | 2810.057 | 17663 | 65535 | 27775 |

Example 13

100-Cycle Machine Test: The testing of Examples 11-12 (including the same glass orientation within the machine) were repeated with modifications to the polymer (Acusol 588, Armak 2075 (equivalent to AR 545), PR-4921) in the alkaline detergent formulation.

Results/Observations:

Block formulation with Armak 2075: The glasses looked clean (with an acceptable level of residue in comparison to commercial products run at 1000 ppm) (with lightbox grading shown in Table 15). The pan was run for 1000 cycles, and looks good having minimal discoloration, other than white areas that correspond to rinsing patterns, and some water patterns on the back. Sump water is visibly cloudy. The Mass of aluminum pan before: 396.97 g; Mass of aluminum pan after: 397.10 g. The % T at 560 nm after 100 cycles: 96.5.

TABLE 15

(Light box grading)

| Label | Area | Mean | StdDev | Min | Max | Median |
|---|---|---|---|---|---|---|
| Glass #1 | 47664 | 24324.63 | 2632.158 | 14207 | 42535 | 24639 |
| Glass #2 | 47664 | 33249.1 | 3875.879 | 21567 | 54655 | 33855 |
| Glass #3 | 47664 | 26708.95 | 2465.614 | 18239 | 43711 | 27135 |
| Glass #4 | 47664 | 26100.21 | 3148.555 | 15295 | 44351 | 26623 |
| Glass #5 | 47664 | 25092.22 | 2412.19 | 17791 | 49087 | 25279 |
| Glass #6 | 47664 | 24694.93 | 2657.785 | 14271 | 55167 | 24831 |
| Clean glass | 47664 | 24324.63 | 2632.158 | 14207 | 41535 | 24639 |

Block formulation with PR-4921 (equivalent to Aquatreat AR545, available from Nalco): The glasses looked quite good here (with lightbox grading shown in Table 16), comparable to the glasses washed with Armak 2075. Pan also looks goods—was only run for 50 cycles here due to time constraints. Sump water looks very cloudy again. The mass of aluminum pan before: 399.96; Mass of aluminum pan after: 400.68 g. The % T at 560 nm after 100 cycles: 93.3.

TABLE 16

(Light box grading)

| Label | Area | Mean | StdDev | Min | Max | Median |
|---|---|---|---|---|---|---|
| Glass #1 | 47664 | 25627.28 | 2588.474 | 16447 | 39359 | 25983 |
| Glass #2 | 47664 | 33181.68 | 3820.874 | 21823 | 55167 | 33599 |
| Glass #3 | 47664 | 29386.17 | 2345.499 | 19647 | 50495 | 29567 |
| Glass #4 | 47664 | 33851.49 | 3487.793 | 22079 | 55103 | 34175 |
| Glass #5 | 47664 | 28723.26 | 2608.054 | 20607 | 46207 | 28927 |
| Glass #6 | 47664 | 27535.3 | 3081.228 | 18303 | 65535 | 27711 |
| Clean glass | 47664 | 21365.72 | 2296.825 | 11327 | 36479 | 21695 |

The inventions being thus described, it will be obvious that the same may be varied in many ways. Such variations are not to be regarded as a departure from the spirit and scope of the inventions and all such modifications are intended to be included within the scope of the following claims.

What is claimed is:

1. An alkaline, corrosion inhibiting composition comprising:

a corrosion inhibitor component comprising at least one phosphonated oligomer of maleic acid having the general formula $H[CHCO_2MCHCO_2M]_nPO_3M_2$ wherein M is a cation, and n is greater than 1, wherein the corrosion inhibitor component is in an amount sufficient for reducing corrosion of pewter, aluminum or aluminum containing alloys;

an alkalinity source;

at least one copolymer comprising acrylic acid/2-Acrylamido-2-methylpropane sulfonic acid or derivatives thereof; and at least one nonionic surfactant;

wherein the composition is substantially free of silicates.

2. The detergent composition according to claim 1, wherein the corrosion inhibitor component comprises between about 0.1 wt-% and about 75 wt-% of the composition.

3. The detergent composition according to claim 1, further comprising a complexing agent.

4. The detergent composition according to claim 3, wherein the complexing agent comprises citric acid or a citrate salt.

5. The detergent composition according to claim 1, wherein the corrosion inhibitor comprises at least one phosphono ethane carboxylate.

6. The detergent composition according to claim 5, wherein the alkalinity source is in an amount sufficient to provide a use solution with a pH of at least 8.0.

7. The detergent composition according to claim 6, wherein the corrosion inhibitor component is tetrasodium phosphonoethane-1,2-dicarboxylate and hexasodium phosphonobutane-1,2,3,4-tetracarboxylate.

8. The detergent composition according to claim 1, further comprising a cleaning agent comprising at least one of an anionic surfactant, a cationic surfactant, or an amphoteric surfactant.

9. The detergent composition according to claim 1, wherein the alkalinity source comprises an alkali metal hydroxide and/or an alkali metal carbonate.

10. The detergent composition according to claim 1, further comprising sodium gluconate.

11. The detergent composition according to claim 1, wherein the composition is a solid.

12. An alkaline, corrosion inhibiting composition comprising:

a corrosion inhibitor component in an amount sufficient for reducing corrosion of pewter, aluminum or aluminum containing alloys, wherein the corrosion inhibitor comprises a phosphonated oligomer of maleic acid comprising a phosphono ethane carboxylate, wherein the corrosion inhibitor component has the general formula $H[CHCO_2MCHCO_2M]_nPO_3M_2$ wherein M is a cation, and n is greater than 1;

an alkali metal alkalinity source in an amount sufficient to provide a use solution with a pH of at least 8.0;

at least one copolymer comprising acrylic acid/2-Acrylamido-2-methylpropane sulfonic acid (AMPS) or derivatives thereof and a polycarboxylic acid;

at least one complexing agent comprising citric acid or a citrate salt; and at least one nonionic surfactant;

wherein the composition is substantially free of silicates.

13. The detergent composition according to claim 12, wherein the corrosion inhibitor component comprises between about 1 wt-% and about 50 wt-% of the composition.

14. The detergent composition according to claim 12, wherein the phosphono ethane carboxylate corrosion inhibitor component is tetrasodium phosphonoethane-1,2-dicarboxylate and hexasodium phosphonobutane-1,2,3,4-tetracarboxylate.

15. The detergent composition according to claim 12, wherein the alkaline source comprises an alkali metal hydroxide and the composition comprises from about 5 wt-% to about 25 wt-% corrosion inhibitor component, from about 40 wt-% to about 90 wt-% alkalinity source, from about 5 wt-% to about 15 wt-% AMPS and polycarboxylic acid copolymer, and from about 10 wt-% to about 30 wt-% complexing agent.

16. The detergent composition according to claim 12, further comprising sodium gluconate.

17. A method for cleaning and/or protecting from corrosion articles made of alkaline-sensitive metals and/or metal containing alloys, the method comprising:

contacting the alkaline-sensitive metal and/or metal alloy surface with the alkaline, corrosion inhibiting composition of claim 1.

18. The method of claim 17, wherein the corrosion inhibiting composition is a solid that is contacted with hard water to generate a use solution, and wherein said use solution contacts said surface by spraying, dipping, immersing, providing a sump-pump solution, providing a clean in place solution and/or misting.

19. The method of claim 17, wherein the corrosion inhibitor is tetrasodium phosphonoethane-1,2-dicarboxylate and hexasodium phosphonobutane-1,2,3,4-tetracarboxylate.

* * * * *